US007725315B2

(12) United States Patent
Hetherington et al.

(10) Patent No.: US 7,725,315 B2
(45) **Date of Patent: *May 25, 2010**

(54) MINIMIZATION OF TRANSIENT NOISES IN A VOICE SIGNAL

(75) Inventors: Phillip A. Hetherington, Port Moody (CA); Shreyas Paranjpe, Vancouver (CA)

(73) Assignee: QNX Software Systems (Wavemakers), Inc., Vancouver, British Columbia (CA)

( * ) Notice: Subject to any disclaimer, the term of this patent is extended or adjusted under 35 U.S.C. 154(b) by 669 days.

This patent is subject to a terminal disclaimer.

(21) Appl. No.: 11/252,160

(22) Filed: Oct. 17, 2005

(65) Prior Publication Data

US 2006/0100868 A1 May 11, 2006

Related U.S. Application Data

(63) Continuation-in-part of application No. 10/688,802, filed on Oct. 16, 2003, which is a continuation-in-part of application No. 10/410,736, filed on Apr. 10, 2003.

(60) Provisional application No. 60/449,511, filed on Feb. 21, 2003.

(51) Int. Cl.
*G10F 15/20* (2006.01)
*G10F 21/02* (2006.01)

(52) U.S. Cl. ..... 704/233; 704/266

(58) Field of Classification Search ..... 704/226, 704/233

See application file for complete search history.

(56) References Cited

U.S. PATENT DOCUMENTS 4,486,900 A 12/1984 Cox et al.
4,531,228 A 7/1985 Noso et al.
4,630,304 A 12/1986 Borth et al.
4,630,305 A 12/1986 Borth et al.

(Continued)

FOREIGN PATENT DOCUMENTS

CA 2158847 9/1994

(Continued)

OTHER PUBLICATIONS

Vaseghi "Advanced Digital Signal Processing and Noise Reduciton", John Wiley and Sons, 2000.*

(Continued)

*Primary Examiner*—Richemond Dorvil
*Assistant Examiner*—Jialong He
(74) *Attorney, Agent, or Firm*—Brinks Hofer Gilson & Lione

(57) ABSTRACT

A voice enhancement system is provided for improving the perceptual quality of a processed voice signal. The system improves the perceptual quality of a received voice signal by removing unwanted noise from a voice signal recorded by a microphone or from some other source. Specifically, the system removes sounds that occur within the environment of the signal source but which are unrelated to speech. The system is especially well adapted for removing transient road noises from speech signals recorded in moving vehicles. Transient road noises include common temporal and spectral characteristics that can be modeled. A transient road noise detector employs such models to detect the presence of transient road noises in a voice signal. If transient road noises are found to be present, a transient road noise attenuator is provided to remove them from the signal.

17 Claims, 12 Drawing Sheets

U.S. PATENT DOCUMENTS

| | | | | |
|---|---|---|---|---|
| 4,811,404 | A | 3/1989 | Vilmur et al. | |
| 4,843,562 | A | 6/1989 | Kenyon et al. | |
| 4,845,466 | A | 7/1989 | Hariton et al. | |
| 5,012,519 | A | 4/1991 | Adlersberg et al. | |
| 5,027,410 | A | 6/1991 | Williamson et al. | |
| 5,056,150 | A | 10/1991 | Yu et al. | |
| 5,146,539 | A | 9/1992 | Doddington et al. | |
| 5,251,263 | A | 10/1993 | Andrea et al. | |
| 5,313,555 | A | 5/1994 | Kamiya | |
| 5,400,409 | A | 3/1995 | Linhard | |
| 5,426,703 | A | 6/1995 | Hamabe et al. | |
| 5,426,704 | A * | 6/1995 | Tamamura et al. | 381/71.9 |
| 5,442,712 | A | 8/1995 | Kawamura et al. | |
| 5,479,517 | A | 12/1995 | Linhard | |
| 5,485,522 | A * | 1/1996 | Solve et al. | 381/56 |
| 5,495,415 | A | 2/1996 | Ribbens et al. | |
| 5,502,688 | A | 3/1996 | Recchione et al. | |
| 5,526,466 | A | 6/1996 | Takizawa | |
| 5,550,924 | A | 8/1996 | Helf et al. | |
| 5,568,559 | A | 10/1996 | Makino | |
| 5,584,295 | A | 12/1996 | Muller et al. | |
| 5,586,028 | A * | 12/1996 | Sekine et al. | 701/1 |
| 5,617,508 | A | 4/1997 | Reaves | |
| 5,651,071 | A | 7/1997 | Lindemann et al. | |
| 5,677,987 | A * | 10/1997 | Seki et al. | 704/226 |
| 5,680,508 | A | 10/1997 | Liu | |
| 5,692,104 | A | 11/1997 | Chow et al. | |
| 5,701,344 | A | 12/1997 | Wakui | |
| 5,727,072 | A * | 3/1998 | Raman | 381/94.2 |
| 5,752,226 | A * | 5/1998 | Chan et al. | 704/233 |
| 5,809,152 | A * | 9/1998 | Nakamura et al. | 381/71.8 |
| 5,859,420 | A | 1/1999 | Borza | |
| 5,878,389 | A | 3/1999 | Hermansky et al. | |
| 5,920,834 | A | 7/1999 | Sih et al. | |
| 5,933,495 | A | 8/1999 | Oh | |
| 5,933,801 | A | 8/1999 | Fink et al. | |
| 5,949,888 | A | 9/1999 | Gupta et al. | |
| 5,982,901 | A | 11/1999 | Kane et al. | |
| 6,011,853 | A | 1/2000 | Koski et al. | |
| 6,108,610 | A | 8/2000 | Winn | |
| 6,122,384 | A | 9/2000 | Mauro | |
| 6,130,949 | A | 10/2000 | Aoki et al. | |
| 6,163,608 | A | 12/2000 | Romesburg et al. | |
| 6,167,375 | A | 12/2000 | Miseki et al. | |
| 6,173,074 | B1 | 1/2001 | Russo | |
| 6,175,602 | B1 | 1/2001 | Gustafsson et al. | |
| 6,192,134 | B1 | 2/2001 | White et al. | |
| 6,199,035 | B1 | 3/2001 | Lakaniemi et al. | |
| 6,208,268 | B1 * | 3/2001 | Scarzello et al. | 340/941 |
| 6,230,123 | B1 | 5/2001 | Mekuria et al. | |
| 6,252,969 | B1 | 6/2001 | Ando | |
| 6,289,309 | B1 * | 9/2001 | deVries | 704/233 |
| 6,405,168 | B1 | 6/2002 | Bayya et al. | |
| 6,415,253 | B1 | 7/2002 | Johnson | |
| 6,434,246 | B1 | 8/2002 | Kates et al. | |
| 6,453,285 | B1 | 9/2002 | Anderson et al. | |
| 6,507,814 | B1 | 1/2003 | Gao | |
| 6,510,408 | B1 | 1/2003 | Hermansen | |
| 6,587,816 | B1 | 7/2003 | Chazan et al. | |
| 6,615,170 | B1 | 9/2003 | Liu et al. | |
| 6,643,619 | B1 | 11/2003 | Linhard et al. | |
| 6,687,669 | B1 | 2/2004 | Schrögmeier et al. | |
| 6,711,536 | B2 | 3/2004 | Rees | |
| 6,741,873 | B1 | 5/2004 | Doran et al. | |
| 6,766,292 | B1 | 7/2004 | Chandran et al. | |
| 6,768,979 | B1 | 7/2004 | Menedez-Pidal et al. | |
| 6,782,363 | B2 | 8/2004 | Lee et al. | |
| 6,822,507 | B2 | 11/2004 | Buchele | |
| 6,859,420 | B1 | 2/2005 | Coney et al. | |
| 6,882,736 | B2 | 4/2005 | Dickel et al. | |
| 6,910,011 | B1 * | 6/2005 | Zakarauskas | 704/233 |
| 6,937,980 | B2 | 8/2005 | Krasny et al. | |
| 6,959,276 | B2 | 10/2005 | Droppo et al. | |
| 7,043,030 | B1 | 5/2006 | Furuta | |
| 7,047,047 | B2 | 5/2006 | Acero et al. | 455/563 |
| 7,062,049 | B1 * | 6/2006 | Inoue et al. | 381/71.4 |
| 7,072,831 | B1 * | 7/2006 | Etter | 704/233 |
| 7,092,877 | B2 | 8/2006 | Ribic | |
| 7,117,145 | B1 * | 10/2006 | Venkatesh et al. | 704/200 |
| 7,117,149 | B1 | 10/2006 | Zakarauskas | |
| 7,158,932 | B1 * | 1/2007 | Furuta | 704/226 |
| 7,165,027 | B2 | 1/2007 | Kellner et al. | |
| 7,313,518 | B2 | 12/2007 | Scalart et al. | |
| 7,386,217 | B2 | 6/2008 | Zhang | |
| 2001/0028713 | A1 | 10/2001 | Walker | |
| 2002/0037088 | A1 | 3/2002 | Dickel et al. | |
| 2002/0071573 | A1 | 6/2002 | Finn | |
| 2002/0094100 | A1 | 7/2002 | Kates et al. | |
| 2002/0094101 | A1 | 7/2002 | De Roo et al. | |
| 2002/0176589 | A1 | 11/2002 | Buck et al. | |
| 2003/0040908 | A1 | 2/2003 | Yang et al. | |
| 2003/0147538 | A1 | 8/2003 | Elko | |
| 2003/0151454 | A1 | 8/2003 | Buchele | |
| 2003/0216907 | A1 | 11/2003 | Thomas | |
| 2004/0078200 | A1 | 4/2004 | Alves | |
| 2004/0093181 | A1 * | 5/2004 | Lee | 702/150 |
| 2004/0138882 | A1 | 7/2004 | Miyazawa | |
| 2004/0161120 | A1 | 8/2004 | Petersen et al. | |
| 2004/0165736 | A1 | 8/2004 | Hetherington et al. | |
| 2004/0167777 | A1 | 8/2004 | Hetherington et al. | |
| 2005/0114128 | A1 | 5/2005 | Hetherington et al. | |
| 2005/0238283 | A1 | 10/2005 | Faure et al. | |
| 2005/0240401 | A1 | 10/2005 | Ebenezer | |
| 2006/0034447 | A1 | 2/2006 | Alves et al. | |
| 2006/0074646 | A1 | 4/2006 | Alves et al. | |
| 2006/0115095 | A1 | 6/2006 | Glesbrecht et al. | |
| 2006/0116873 | A1 | 6/2006 | Hetherington et al. | |
| 2006/0136199 | A1 | 6/2006 | Nongpiur et al. | |
| 2006/0251268 | A1 | 11/2006 | Hetherington et al. | |
| 2006/0287859 | A1 | 12/2006 | Hetherington et al. | |
| 2007/0019835 | A1 | 1/2007 | De Roo et al. | |
| 2007/0033031 | A1 | 2/2007 | Zakarauskas | |

FOREIGN PATENT DOCUMENTS

| | | | |
|---|---|---|---|
| CA | 2157496 | | 10/1994 |
| CA | 2158064 | | 10/1994 |
| CN | 1325222 | A | 12/2001 |
| EP | 0 076 687 | A1 | 4/1983 |
| EP | 0 629 996 | A2 | 12/1994 |
| EP | 0 629 996 | A3 | 12/1994 |
| EP | 0 750 291 | A1 | 12/1996 |
| EP | 1 450 353 | A1 | 8/2004 |
| EP | 1 450 354 | A1 | 8/2004 |
| EP | 1 669 983 | A1 | 6/2006 |
| JP | 64-39195 | | 2/1989 |
| JP | 06269084 | | 9/1994 |
| JP | 6282297 | | 10/1994 |
| JP | 06319193 | | 11/1994 |
| JP | 6349208 | | 12/1994 |
| JP | 2001215992 | | 8/2001 |
| WO | WO 00-41169 | A1 | 7/2000 |
| WO | WO 01-56255 | A1 | 8/2001 |
| WO | WO 01-73761 | A1 | 10/2001 |

OTHER PUBLICATIONS

Ephraim, "Statistical Model Based Speech Enhancement Systems", Proceedings of IEEE, 1992.*

Godsill et al., "Digital Audio Restoration", University of Cambridge, UK, 1997.*

Vaseghi, "Advanced Digital Signal Processing and Noise Reduction", Chapter 12, Published by John Wiley and Son, 2000.*

Berk et al., "Data Analysis with Microsoft Excel", Duxbury Press, 1998, pp. 236-239 and 256-259.

Seely, S., "An Introduction to Engineering Systems", Pergamon Press Inc., 1972, pp. 7-10.
European Search Report for Application No. 04003675.8-2218, dated May 12, 2004.
Puder, H. et al., "Improved Noise Reduction for Hands-Free Car Phones Utilizing Information on Vehicle and Engine Speeds", Sep. 4-8, 2000, pp. 1851-1854, vol. 3, XP009030255, 2000, Tampere, Finland, Tampere Univ. Technology, Finland Abstract.
Shust, Michael R. And Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.
Shust, Michael R. and Rogers, James C., "Electronic Removal of Outdoor Microphone Wind Noise", obtained from the Internet on Oct. 5, 2006 at: <http://www.acoustics.org/press/136th/mshust.htm>, 6 pages.
Wahab A. et al., "Intelligent Dashboard With Speech Enhancement", Information, Communications and Signal Processing, 1997. ICICS, Proceedings of 1997 International Conference on Singapore, Sep. 9-12, 1997, New York, NY, USA, IEEE, pp. 993-997.
Pellom, B.; Hansen, J., An Improved (Auto:I,LSP:T) Constrained Iterative Speech Enhancement for Colored Noise Environments, Speech and Audio Processing, IEEE Transactions on vol. 6, Issue 6, Nov. 1998, pp. 573-579.
Avendano, C., Hermansky, H., "Study on the Dereverberation of Speech Based on Temporal Envelope Filtering," Proc. ICSLP '96, pp. 889-892, Oct. 1996.
Fiori, S., Uncini, A., and Piazza, F., "Blind Deconvolution by Modified Bussgang Algorithm", Dept. of Electronics and Automatics—University of Ancona (Italy), ISCAS 1999.
Learned, R.E. et al., A Wavelet Packet Approach to Transient Signal Classification, Applied and Computational Harmonic Analysis, Jul. 1995, pp. 265-278, vol. 2, No. 3, USA, XP 000972660. ISSN: 1063-5203. abstract.
Nakatani, T., Miyoshi, M., and Kinoshita, K., "Implementation and Effects of Single Channel Dereverberation Based on the Harmonic Structure of Speech," Proc. of IWAENC-2003, pp. 91-94, Sep. 2003.
Quatieri, T.F. et al., Noise Reduction Using a Soft-Dection/Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, Abstract, Paragraph 3.1.
Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.
Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.
Vieira, J., "Automatic Estimation of Reverberation Time", Audio Engineering Society, Convention Paper 6107, 116th Convention, May 8-11, 2004, Berlin, Germany, pp. 1-7.
Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.
Ljung, Lennart, "System Identification Theory for the User, Second Edition" 1999, pp. 1-14, Prentice Hall PTR, Upper Saddle River, NJ.
Boll, "Suppression of Acoustic Noise in Speech Using Spectral Subtraction", IEEE Trans. On Acoustics, Speech, and Signal Processing, Apr. 1979, pp. 113-120.
Updrea, R. M. et al., "Speech Enhancement Using Spectral Over-Subtraction and Residual Noise Reduction," IEEE, 2003, pp. 165-168.

* cited by examiner

MINIMIZATION OF TRANSIENT NOISES IN A VOICE SIGNAL

PRIORITY CLAIM

This application is a continuation-in-part of U.S. application Ser. No. 10/688,802 "System for Suppressing Wind Noise," filed Oct. 16, 2003, which is a continuation-in-part of U.S. application Ser. No. 10/410,736, "Method and Apparatus for Suppressing Wind Noise," filed Apr. 10, 2003, which claims priority to U.S. Application No. 60/449,511, "Method for Suppressing Wind Noise" filed on Feb. 21, 2003. The disclosures of the above applications are incorporated herein by reference.

BACKGROUND OF THE INVENTION

1. Technical Field

This invention relates to acoustics, and more particularly, to a system that enhances the perceptual quality of a processed voice.

2. Related Art

Many communication devices acquire, assimilate, and transfer a voice signal. Voice signals pass from one system to another through a communication medium. In some systems, including some systems used in vehicles, the clarity of the voice signal does not only depend on the quality of the communication system and the quality of the communication medium, but also on the amount of noise that accompanies the voice signal. When noise occurs near a source or a receiver, distortion often garbles the voice signal and destroys information. In some instances, noise may completely mask the voice signal so that the information conveyed by the voice signal is completely unrecognizable either by a listener or by a voice recognition system.

Noise, which may be annoying, distracting, or that results in lost information comes from many sources. Noise from a vehicle may be created by the engine, the road, the tires, or by the movement of air. When a vehicle is in motion on a paved road, a significant amount of the noise is produced when the tires strike obstructions or imperfections in the road surface. Transient road noises may be created when the tires strike obstructions such as bumps, cracks, cat eyes, expansion joints, and the like.

Transient road noises share a number of common characteristics which allow them to be identified as such. The most significant attribute of transient road noises is that they typically include a pair of related sounds or sonic events. The two sounds are generated when first the front wheels of the vehicle strike an obstruction followed by the rear wheels striking the same obstruction. The two sounds are separated in time by the length of time necessary for the rear wheels to travel the length of the vehicle's wheelbase given the vehicle's rate of travel. Furthermore, the sounds generated when the front and rear tires strike an object are broadband events having a characteristic spectro-temporal shape. Because most vehicles ride on air filled rubber tires the sounds generated when the tires strike an object have significant low frequency energy. Thus, the spectral shape is characterized by a rapid rise in signal intensity in the lower frequency ranges, a peak intensity, followed by a general tapering off in the higher frequency ranges.

These characteristics may be employed to identify the presence of transient road noises in a voice signal generated by a microphone or other source within a vehicle. Once transient road noises have been identified in a signal, steps may be taken to remove them.

SUMMARY

A voice enhancement system is provided for improving the perceptual quality of a processed voice signal. The system improves the perceptual quality of a received voice signal by removing unwanted noise from a voice signal recorded by a microphone or from some other source. Specifically, the system removes sounds that occur within the environment of the signal source but which are unrelated to speech. The system is especially well adapted for removing transient road noises from speech signals recorded in moving vehicles.

The system models both the temporal and spectral characteristics of transient road noises. Thereafter the system analyzes received signals to determine whether the received signals contain sounds that correspond to the modeled transient road noises. If so, they are removed or attenuated from the received signal, providing a cleaner more comprehensible version of the original speech signal. The system is very well adapted for removing transient road noises from signals recorded by a hands free telephone system or voice recognition system located in the cabin of an automobile or other vehicle.

According to an embodiment of a transient road noise suppression system, a transient road noise detector is adapted to detect the presence of transient road noises in a received signal is provided. The transient road noise detector operates in conjunction with a transient road noise attenuator. Transient road noises detected by the transient road noise detector are substantially removed or attenuated by the transient road noise attenuator.

In another embodiment a transient road noise detector is provided for detecting the presence of transient road noises in a signal. The transient road noise detector includes an analog to digital converter for converting a received signal into a digital signal and a windowing function generator for dividing the digitized signal into a plurality of individual analysis windows. A transform module transforms the individual analysis windows from time domain signals into frequency domain short term spectra. A modeler is provided for generating and/or storing model attributes of transient road noise. The modeler then compares the attributes of the short term spectra of the transformed analysis windows to the attributes of the modeled transient road noises in order to determine whether transient road noise are present in the received signal.

A method of removing transient road noises is also provided. The method includes modeling various temporal and spectral characteristics of transient road noises. According to the method, received signals are analyzed to determine whether characteristics of the received signal correspond to the modeled characteristics of transient road noises. If so, the portions of the signal corresponding to the modeled characteristics of the transient road noises are substantially removed from the signal.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like referenced numerals designate corresponding parts throughout the different views.

DETAILED DESCRIPTION OF THE INVENTION

A voice enhancement system improves the perceptual quality of a processed voice signal. The system models transient road noises produced when the tires of a moving vehicle, such as an automobile, strike a bump, crack, or other obstacle or imperfection in the road surface over which the vehicle is traveling. The system analyzes a received audio signal to determine whether characteristics of the received audio signal conform to the modeled characteristics of transient road noises. If so, the system may eliminate or dampen the transient road noises in the received signal. Transient road noises may be attenuated in the presence or absence of speech, and transient road noises may be detected and eliminated substantially in real time or after a delay, such as a buffering delay (e.g. 300-500 ms). In addition to transient road noises, the voice enhancement system may also dampen or remove continuous background noises, such as engine noise, and other transient noises, such as wind noise, tire noise, passing tire hiss noises, and the like. The system may also eliminate the "musical noise," squeaks, squawks, clicks drips, pops tones and other sound artifacts generated by some voice enhancement systems.

Figure 1:
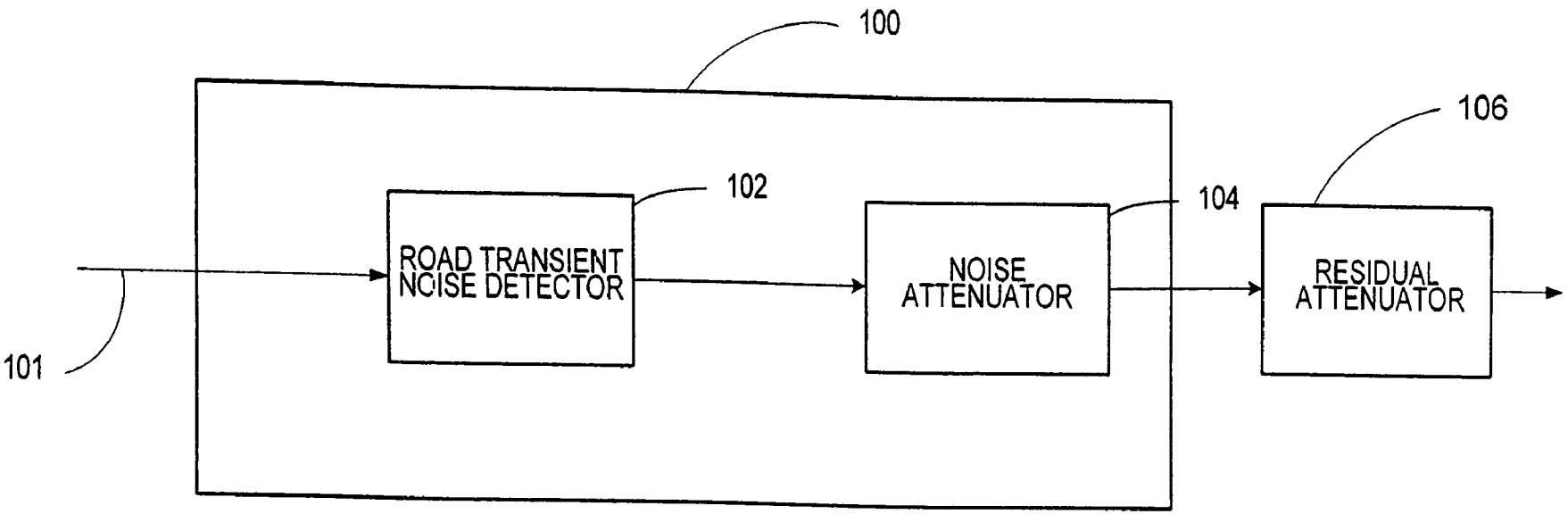
FIG. 1 is a partial block diagram of a voice enhancement system.

FIG. 1 shows a partial block diagram of a voice enhancement system 100. The voice enhancement system may encompass dedicated hardware and/or software that may be executed on one or more electronic processors. Such processors may be running one or more operating systems or no operating system at all. The voice enhancement system 100 includes a road transient noise detector 102 and a noise attenuator 104. A residual attenuator 106 may also be provided to remove artifacts and other unwanted features of the processed signal. As will be described in more detail below, the transient noise detector 102 includes a model, or is capable of generating a model, of transient road noises. Received audio signals that may include both voice and noise components are compared to the model to determine whether the signals include sounds corresponding to transient road noise. If so, the identified sounds can be removed from the signal to provide a clearer more understandable voice signal.

Transient road noises have both temporal and frequency characteristics that may be modeled. The transient road noise detector 102 may employ such a model to determine whether a received audio signal 101 contains sounds corresponding to transient road noises. When the transient road noise detector 102 determines that transient road noises are in fact present in the received signal 101, the transient road noises are substantially removed or dampened by the noise attenuator 104.

The voice enhancement system 100 may encompass any noise attenuating system that substantially removes or dampens transient road noises from a received signal. Examples of systems that may be employed to remove or dampen transient road noises from the received signal may include 1) systems employing a neural network mapping of a noisy signal containing transient road noises to a noise reduced signal; 2) systems which subtract the transient road noise from the received signal; 3) systems that use the noise signal including the transient road noises and the transient road noise model to select a noise-reduced signal from a code book; and 4) systems that in any other way use the noisy signal and the transient road noise model to create a noise-reduced signal based on a reconstruction of the original masked signal or a noise reduced signal. In some instances such transient road noise attenuators may also attenuate continuous noise that may be part of the short term spectra of the received signal 101. The transient road noise attenuator may also interface with or include an optional residual attenuator 106 for removing additional sound artifacts such as the "musical noise", squeaks, squawks, chirps, clicks, drips, pops, tones or others that may result from the attenuation or removal of the transient road noises.

Noise can be broadly divided into two categories: (1a) periodic noise; and (1b) non-periodic noises. Periodic noises include repetitive sounds such as turn indicator clicks, engine or drive train noise and windshield wiper swooshes and the like. Periodic noises may have some harmonic frequency structure due to their periodic nature. Non-periodic noises include sounds such as transient road noises, passing tire hiss, rain, wind buffets, and the like. Non-periodic noises usually occur at irregular non-periodic intervals, do not have a harmonic frequency structure, and typically have a short, transient, time duration. Speech can also be divided into two broad categories: (2a) voiced speech, such as vowel sounds and (2b) unvoiced speech, such as consonants. Voiced speech exhibits a regular harmonic structure, or harmonic peaks weighted by the spectral envelope that may describe the formant structure. Unvoiced speech does not exhibit a harmonic or formant structure. An audio signal including both noise and speech may comprise any combination of non-periodic noises, periodic noises, and voiced or unvoiced speech.

The transient road noise detector 102 may separate the noise-like segments from the remaining signal in real-time or after a delay. The transient road noise detector 102 separates the noise-like segments regardless of the amplitude or complexity of the received signal 101. When the transient road noise detector detects a transient road noise it models both the temporal and spectral characteristics of the detected transient road noise. The transient road noise detector 102 may store the entire model of the transient road noise, or it may store selected attributes of the model. The transient road noise attenuator 104 uses the model or the saved attributes of the model to remove transient road noise from the received signal 101. A plurality of transient road noise models may be used to create an average transient road noise model, or the saved attributes of the model may be otherwise combined for use by the transient road noise attenuator 104 to remove transient road noise from the received signal 101.

Figure 2:
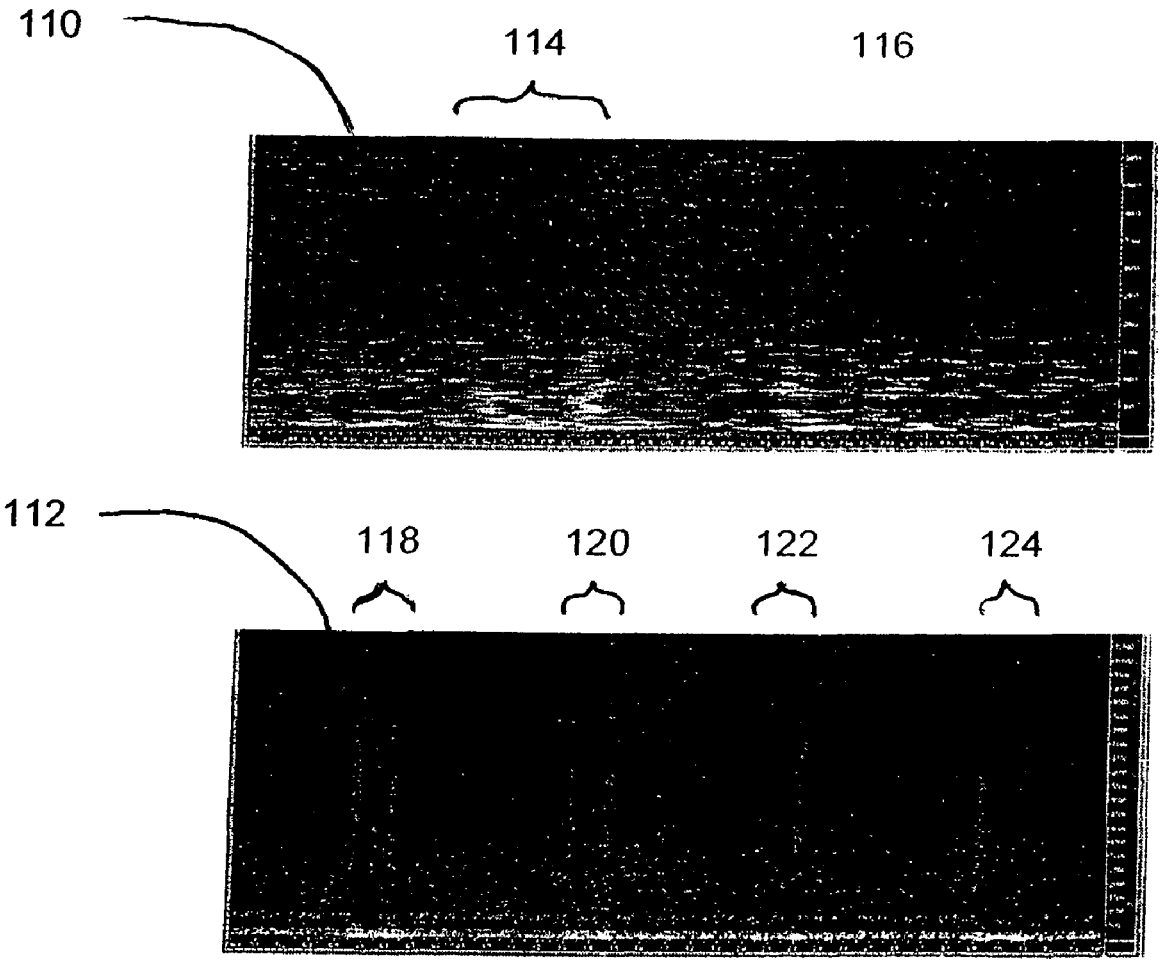
FIG. 2 shows spectrograms of various transient road noises.

FIG. 2 shows two spectrogram plots 110, 112 of different transient road noises. The horizontal axes of the spectrograms represent time, and the vertical axes represents frequency. The intensity of the various transient noises is illustrated by the corresponding tone of the spectrogram plot. Lighter colored areas represent louder more intense sounds whereas darker areas represent quieter sounds or no sound at all. The transient road noises depicted in the two spectrograms are generated from different sources. While the source and the overall characteristics of the transient road noise depicted in the two spectrograms 110, 112 are substantially different, they nonetheless share a number of common traits. In fact, the traits common to the transient road noises depicted in spectrograms 110, 112 are common to most if not all transient road noises. First and foremost is the fact that in the time domain the transient road noises occur as pairs or doublets. A first sound event is followed by a substantially similar sound event a short time later. The first sound event corresponds to the front tires of a vehicle hitting or riding over an obstruction, in the road surface. The second sound event follows when the rear wheels strike the same object, obstruction or surface imperfection. The sonic doublets result in the characteristic "flup-flup" sound familiar to almost everyone who has ridden in an automobile traveling down a highway.

A second characteristic common to most transient road noises is that they share a similar, though not necessarily identical, spectral shape. Transient road noises are generally broadband events, carrying sonic energy across a wide range of frequencies. However, because most vehicles ride on air filled rubber tires, much of the sonic energy of transient road noise events is concentrated in the lower frequency ranges.

These two characteristics of transient road noises are clearly evident in the spectrogram plots 110 and 112 of FIG. 2. The first spectrogram plot 110 shows two transient road noise events of 114, 116. The doublet nature of each transient road noise event is clearly visible. Furthermore, within each component of the sonic doublets substantially all of the energy is found in frequencies below about 2000 Hz. The second spectrogram plot 112 shows a plurality of transient road noise doublets 118, 120, 122, 124 at regularly spaced intervals. Such a pattern may result when a vehicle is traveling over the regularly spaced seams between the slabs of a concrete roadway. Again, the doublet nature of the transient road noise events is strikingly evident. And although the transient road noise events 118, 120, 122 and 124 have more high frequency energy than the events 114, 116 of the previous spectrogram plot 110, the transient road noise events 118, 120, 122 and 124 nonetheless show greater intensity in the lower frequency ranges than at higher frequencies.

Figure 3:
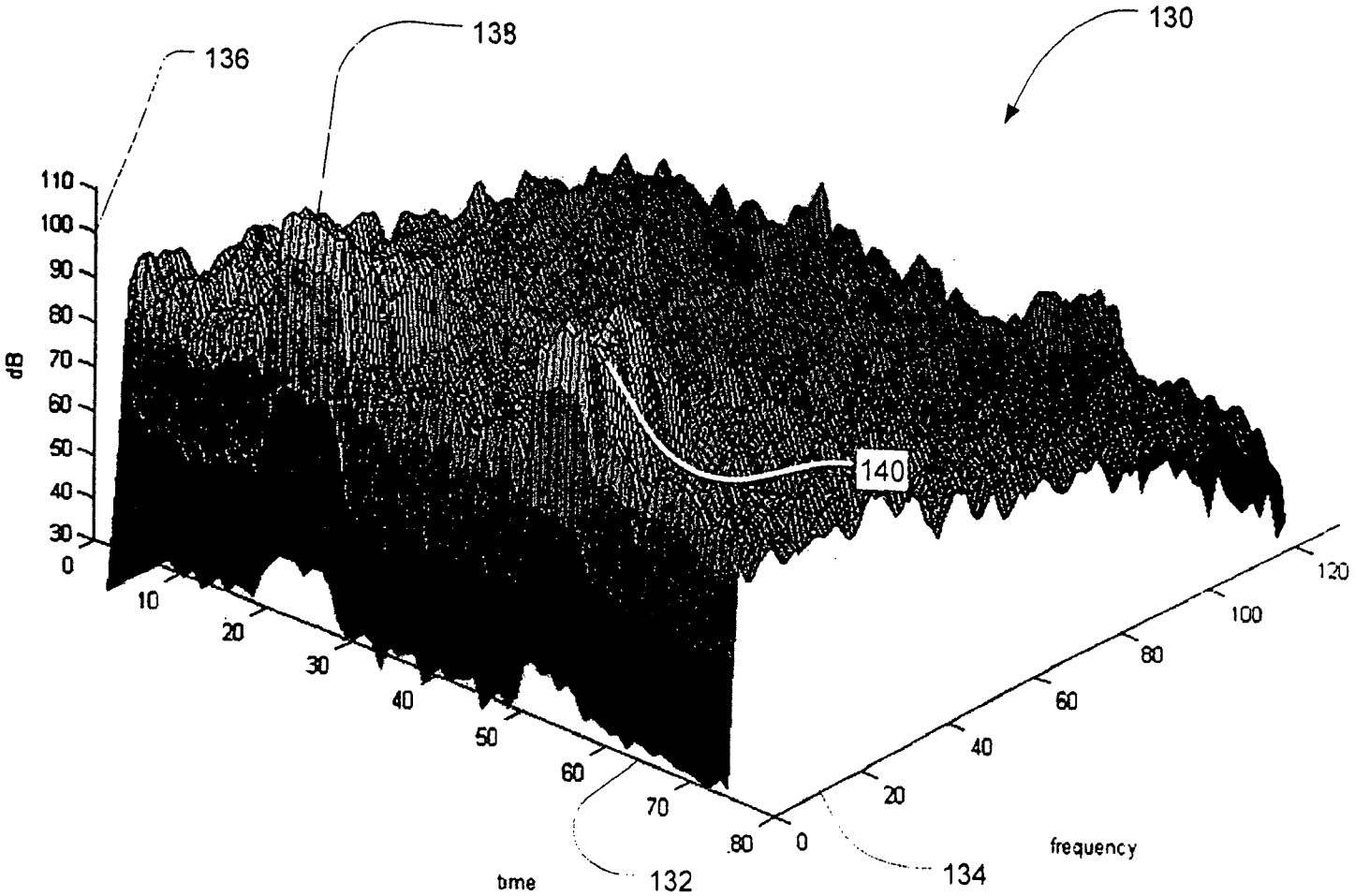
FIG. 3 is a time-frequency domain plot of a transient road noise in the presence of substantial noise.

FIG. 3 shows an idealized three dimensional time-frequency domain plot 130 of the frequency response of a transient road noise in the presence of substantial background noise. The time-frequency domain plot 130 includes a plurality of individual time intervals or frames along the time axis 132. Each time frame represents an instantaneous snapshot of the dB spectrum of a signal received at a microphone or other sound transducer within a vehicle. Frequency is represented along axis 134, and the magnitude of the signal in dB in each time frame and at each frequency is indicated by the height of the curve along the dB axis 136.

The time-frequency domain plot 130 clearly shows two distinct sound events 138, 140. The dual events correspond to the doublet nature of a transient road noises. The first sound event 138 begins to appear between about 20-30 ms and the second 140 between about 48-58 ms. There are a number of features of the two sound events 138, 140 that can be used to identify them as corresponding to a single transient road noise event. The most obvious are the fact that there are two of them, and that they are substantially similar spectrally, and that they occur very close in time to one another. When the length of the vehicle's wheelbase and the speed at which the vehicle is traveling are known, the temporal spacing between the first and second sound events of a single transient road noise doublet may be calculated with precision. A pair of similar sound events that occur at the predicted interval may be assumed to belong to a single transient noise event. Sound events that do not occur at the predicted interval may be assumed not to be part of a common transient road noise event. Thus, under these conditions, when the vehicle wheel base and speed are known, transient road noise detector 102 may identify transient road noises with great precision based on the temporal spacing of the doublets alone. Once such a sonic doublet has been identified as a transient road noise event by the transient road noise detector, both sound events comprising the sonic doublet may be removed by the transient road noise attenuator 104.

If the wheelbase or speed of the vehicle is not available, alternative methods for identifying transient road noises must be employed. For example, an adaptive model may be used to predict the proper temporal spacing of the two sound events associated with transient road noises. A transient road noise detector 102 may identify pairs of noise events that are likely to be transient road noises based on their spectral shape. Using a weighted average, leaky integrator, or some other adaptive modeling technique, the transient road noise detector may quickly establish the appropriate temporal spacing of transient road noise doublets at what ever speed the vehicle is traveling, and regardless of the length of its wheel base.

Of course, in order to model the appropriate spacing of transient road noises it is first necessary to identify sound events that may be part of a transient road noise doublet. This may be accomplished by examining the frequency characteristics of individual sound events. As has already been mentioned, and as is clearly illustrated in the frequency response plot 130, transient road noises have similar spectral characteristics. The individual sound events associated with transient road noise doublet, first the front wheels hitting an obstruction and next the rear wheels hitting the obstruction, are both broad band events that extend over a wide frequency range. For example the two sound events 138 and 140 shown in FIG. 3 include signal energies above the background noise at most of the displayed frequencies. Nonetheless, the highest signal energies are concentrated in the lower frequency ranges. Thus, the shape of frequency spectrum of a transient road noise is characterized by an early peak at a lower frequency and a general tapering off at higher frequencies. These characteristics may be modeled by the transient road noise detector 102. These characteristics found in received signals may be identified by the transient road noise detector as potential transient road noises. Once the transient road noise detector 102 identifies a potential component of a transient road noise doublet, it may look forward or backward in time to identify a companion sound event having the same or similar characteristics to complete the transient road noise doublet. The amount of time that the transient road noise detector looks forward or back in time to locate the companion sound event is determined as mentioned above, either based on the wheelbase of the vehicle and the speed at which it is traveling or by the transient road noise temporal model.

Figure 4:
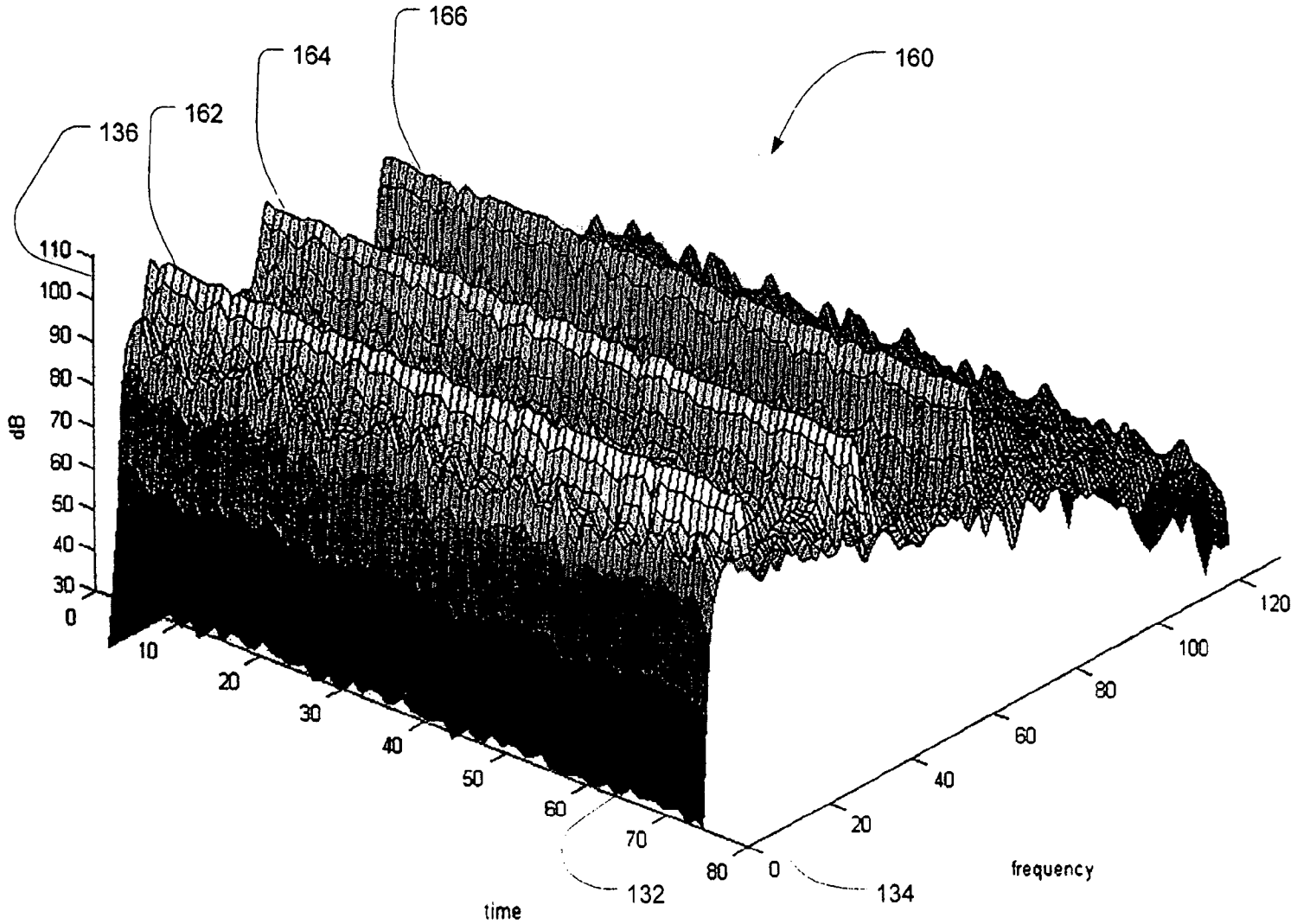
FIG. 4 is a time-frequency domain plot of a spoken vowel sound.

FIG. 4 shows a time-frequency domain plot of the frequency response of a spoken vowel sound 160. The time-frequency domain plot 160 is similar to the time-frequency domain plot 130 of FIG. 3. A plurality of individual time intervals are arrayed along the time axis 132. Frequency values increase along the frequency axis 134. The magnitude of a received signal in dB for each time interval and at each frequency is indicated by the height of the curve along the dB axis 136. The spoken vowel sound is characterized by a plurality of harmonic peaks 162, 164, 166 and that remain substantially constant over the illustrated time interval. Comparing FIGS. 3 and 4, when viewed in the time-frequency domain, the transient road noise of FIG. 3 is clearly distinct from the spoken vowel sound of FIG. 4.

Figure 5:
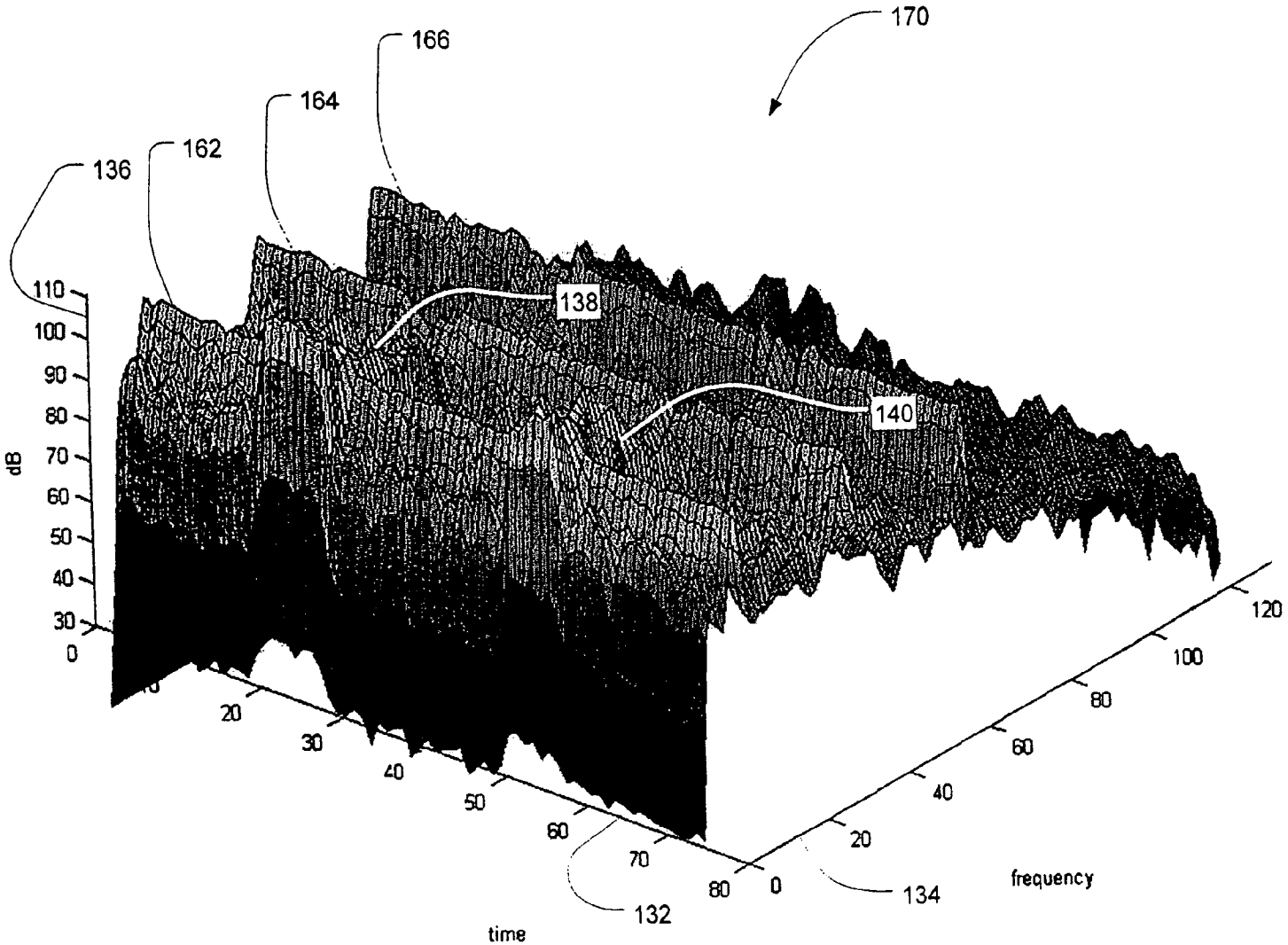
FIG. 5 is a time-frequency domain plot of a combined spoken vowel sound and a transient road noise.

Next, FIG. 5 shows a frequency-time domain plot 170 showing a transient road noise in the presence of a spoken vowel sound and in the presence of substantial background noise. As can be seen, the dual sound events 138, 140 corresponding to a transient road noise partially mask the harmonic peaks 162, 164, 166, of the spoken vowel sound. Nonetheless, the general temporal and spectral shapes of both the spoken vowel sound and the transient road noise are both clearly evident.

Once the sound events associated with transient road noise have been identified in the received signal based on their temporal and spectral characteristics they may be removed or attenuated by the transient road noise attenuator 104. Any number of methods may be used to attenuate, dampen or otherwise remove transient road noises from the received signal. One method may be to add the transient road noise model to a recorded or estimated background noise signal. In the power spectrum the transient road noise and continuous background noise estimate may then be subtracted from the received signal. If a portion of the underlying speech signal is masked by a transient road noise, a conventional or modified stepwise interpolator may be used to reconstruct the missing part of the signal. An inverse FFT may then be used to convert the reconstructed signal into the time domain.

Figure 6:
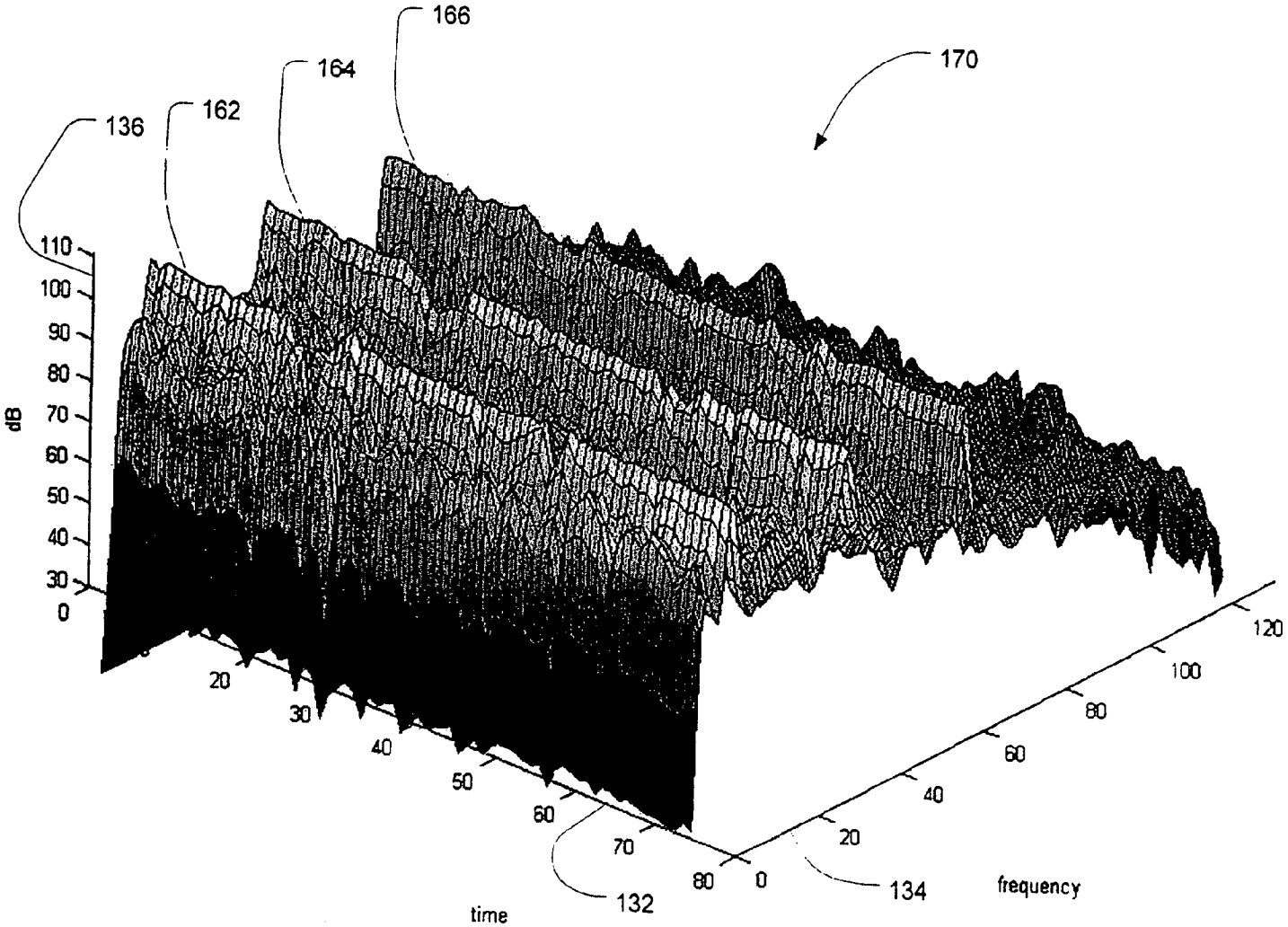
FIG. 6 is a time-frequency domain plot of a signal including a combined spoken vowel and transient road noise from which the transient road noise has been substantially removed.
Figure 7:
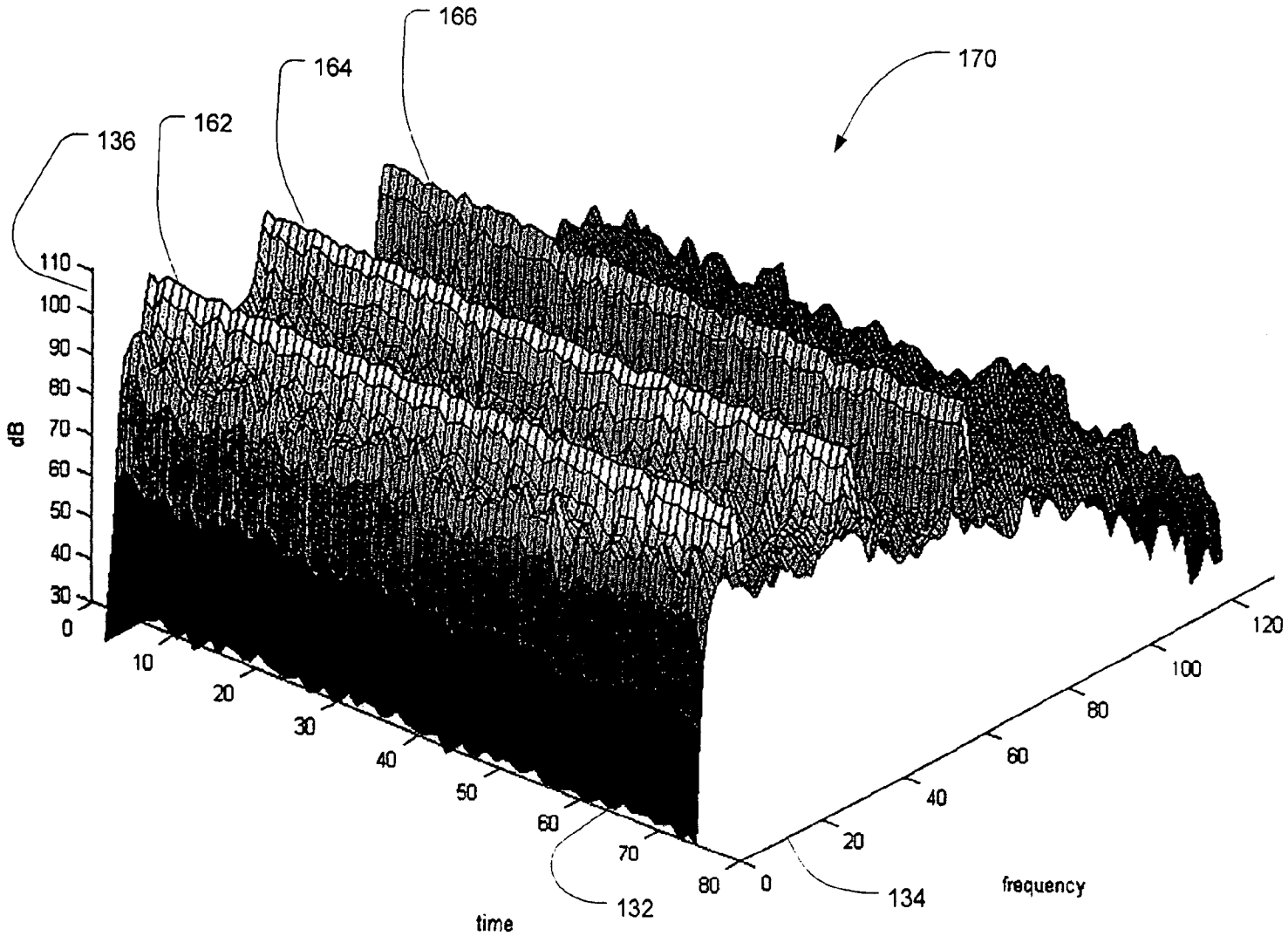
FIG. 7 is a time-frequency domain plot of a signal including a combined spoken vowel and transient road noise from which the transient road noise has been substantially removed, and in which the harmonic peaks distorted by the removed transient road noise have been repaired.

FIG. 6 is a frequency-time domain plot 180 showing a spoken vowel sound in the presence of background noise from which a transient road noise has been removed. Some of the harmonics, 164 and 166 which were completely masked by the transient road noise in FIG. 5 are again visible, although distorted, in FIG. 6. FIG. 7 shows a frequency-time domain plot 190 of the distorted spoken vowel signal of FIG. 6 after a linear step-wise interpolator has reconstructed the distorted parts of the signal. As can be seen, the reconstructed signal of FIG. 7 substantially resembles the undisturbed spoken vowel signal of FIG. 4.

Figure 8:
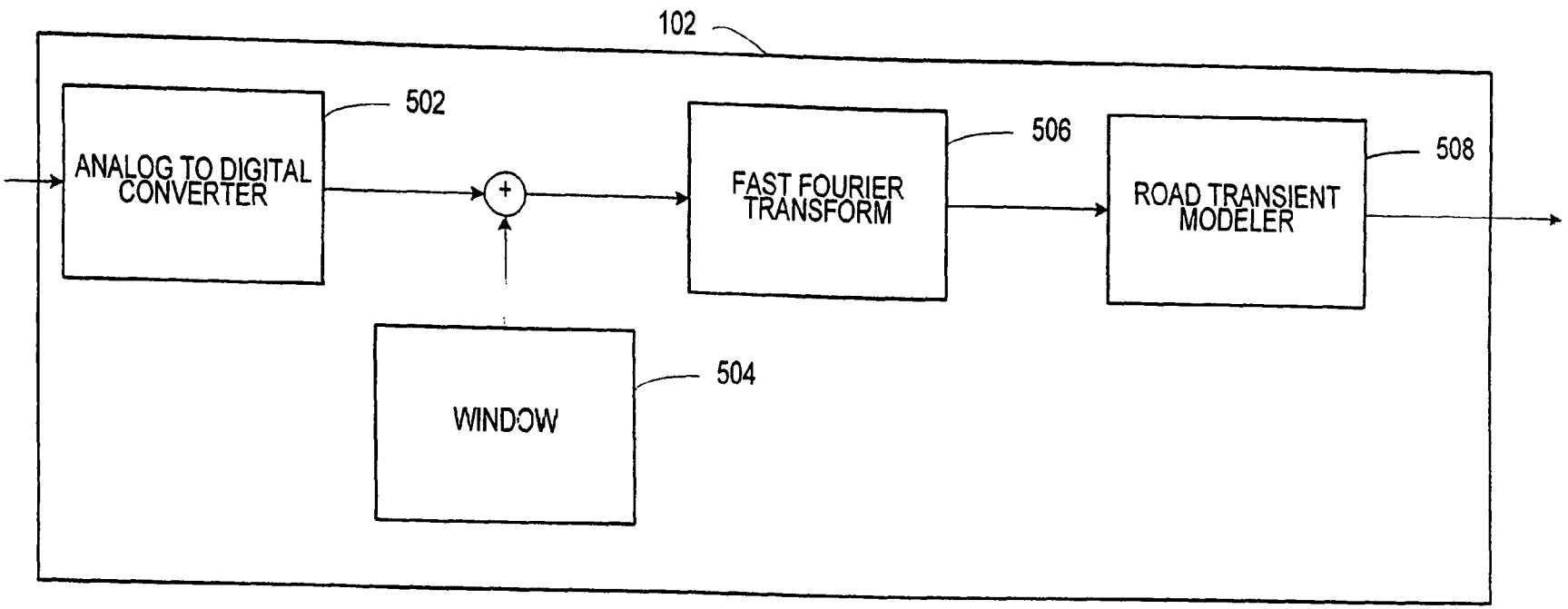
FIG. 8 is a block diagram of an embodiment of a transient road noise detector.

FIG. 8 is a block diagram of an embodiment of a transient road noise detector 102 according to an embodiment of the invention. The transient road noise detector 102 receives or detects an input signal 101 comprising speech, noise and/or a combination of speech and noise. The received or detected signal 101 is digitized at a predetermined frequency. To assure a good quality voice, the voice signal is converted to a pulse-code-modulated (PCM) signal by an analog-to-digital converter 502 (ADC) having any common sample rate. A smoothing window function generator 504 generates a windowing function such as a Hanning window that is applied to blocks of data to obtain a windowed signal. The complex spectrum for the windowed signal may be obtained by means of a fast Fourier transform (FFT) 506 or other time-frequency transformation mechanism. The FFT separates the digitized signal into frequency bins, and calculates the amplitude of the various frequency components of the received signal for each frequency bin. The spectral components of the frequency bins may be monitored over time by a modeler 508.

As described above, there are two aspects to modeling transient road noises. The first is modeling the individual sound events that form the transient road noise doublets, and the second is modeling the appropriate temporal space between the two sound events comprising a transient road noise doublet. Secondly, the individual sound events comprising the transient road noise doublets have a characteristic shape. This shape, or attributes of the characteristic shape, may be generated and/or stored by the modeler 508. A correlation between the spectral and/or temporal shape of a received signal and the modeled shape, or between attributes of the received signal spectrum and the modeled attributes may identify a sound event as potentially belonging to a transient road noise doublet. Once a sound event has been identified as potentially belonging to a transient road noise doublet the modeler 508 may look back to previously analyzed time windows or forward to later received time windows, or forward and back within the same time window, to determine whether a corresponding component of a transient road noise has already been received, or is received later. Thereafter, if a corresponding sound event having the appropriate characteristics is in fact received within an appropriate amount of time either before or after the identified sound event, the two sound events may be identified as components of a single transient road noise doublet.

Alternatively or additionally, the modeler may determine a probability that the signal includes transient road noise, and may identify sound events as transient road noise when that probability exceeds a probability threshold. The correlation and probability thresholds may depend on various factors, including the presence of other noises or speech in the input signal. When the transient road noise detector 102 detects a transient road noise, the characteristics of the detected transient road noise may be provided to the transient road noise attenuator 104 for removal of the transient road noise from the received signal.

As more windows of sound are processed, the transient road noise detector 102 may derive average noise models for both the individual sound events comprising transient road noises and the temporal spacing between them. A time-smoothed or weighted average may be used to model transient road noise sound events and continuous noise estimates for each frequency bin. The average model may be updated when transient road noises are detected in the absence of speech. Fully bounding a transient road noise when updating the average model may increase the probability of accurate detection. A leaky integrator, or weighted average or other method may be used to model the interval between front and rear wheel sound events.

To minimize the "music noise," squeaks, squawks, chirps, clicks, drips, pops, or other sound artifacts, an optional residual attenuator may also condition the voice signal before it is converted to the time domain. The residual attenuator may be combined with the transient road noise attenuator 104, combined with one or more other elements, or comprise a separate element.

The residual attenuator may track the power spectrum within a low frequency range (e.g., from about 0 Hz up to about 2 kHz, which is the range in which most of the energy from transient road noises occurs). When a large increase in signal power is detected an improvement may be obtained by limiting or dampening the transmitted power in the low frequency range to a predetermined or calculated threshold. A calculated threshold may be equal to, or based on, the average spectral power of that same low frequency range at an earlier period in time.

Figure 9:
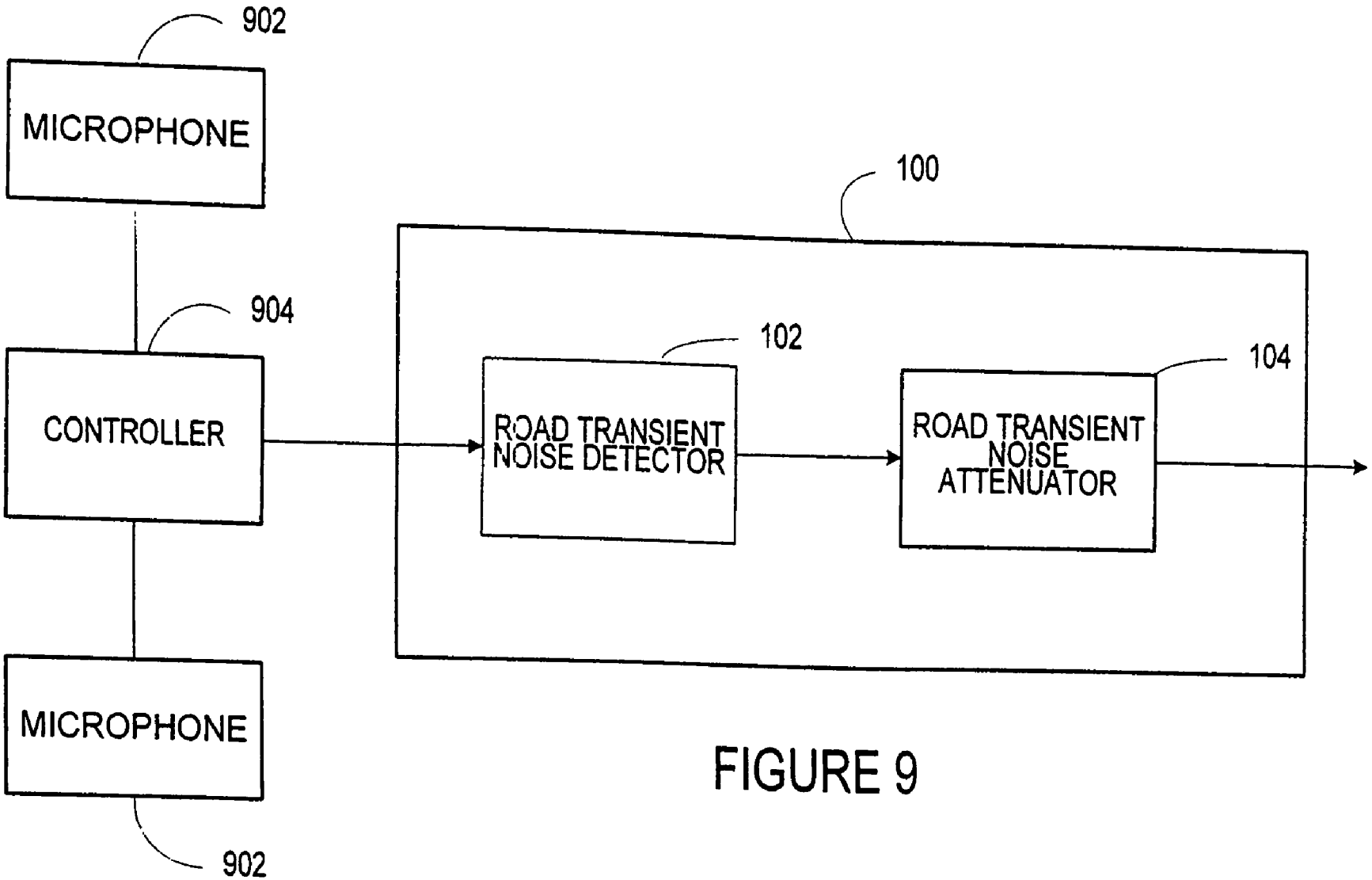
FIG. 9 is an alternative embodiment of a voice enhancement system.

Further improvements to voice quality may be achieved by pre-conditioning the input signal before it is processed by the transient road noise detector 102. One pre-processing system may exploit the lag time caused by a signal arriving at different times at different detectors that are positioned apart from on another as shown in FIG. 9. If multiple detectors or microphones 902 are used that convert sound into an electric signal, the pre-processing system may include a controller 904 that automatically selects the microphone 902 and channel that senses the least amount of noise. When another microphone 902 is selected, the electric signal may be combined with the previously generated signal before being processed by the transient road noise detector 102.

Alternatively, transient road noise detection may be performed on each of the channels. A mixing of one or more channels may occur by switching between the outputs of the microphones 902. Alternatively or additionally, the controller 904 may include a comparator, and a direction of the signal may be detected from differences in the amplitude or timing of signals received from the microphones 902. Direction detection may be improved by pointing the microphones 902 in different directions. The transient road noise detection may be made more sensitive for signals originating outside of the vehicle.

The signals may be evaluated at only frequencies above or below a certain threshold frequency (for example, by using a high-pass or low pass filter). The threshold frequency may be updated over time as the average transient road noise model learns the expected frequencies of transient road noises. For example, when the vehicle is traveling at a higher speed, the threshold frequency for transient road noise detection may be set relatively high, because the maximum frequency of transient road noises may increase with vehicle speed. Alternatively, controller 904 may combine the output signals of multiple microphones 902 at a specific frequency or frequency range through a weighting function.

Figure 10:
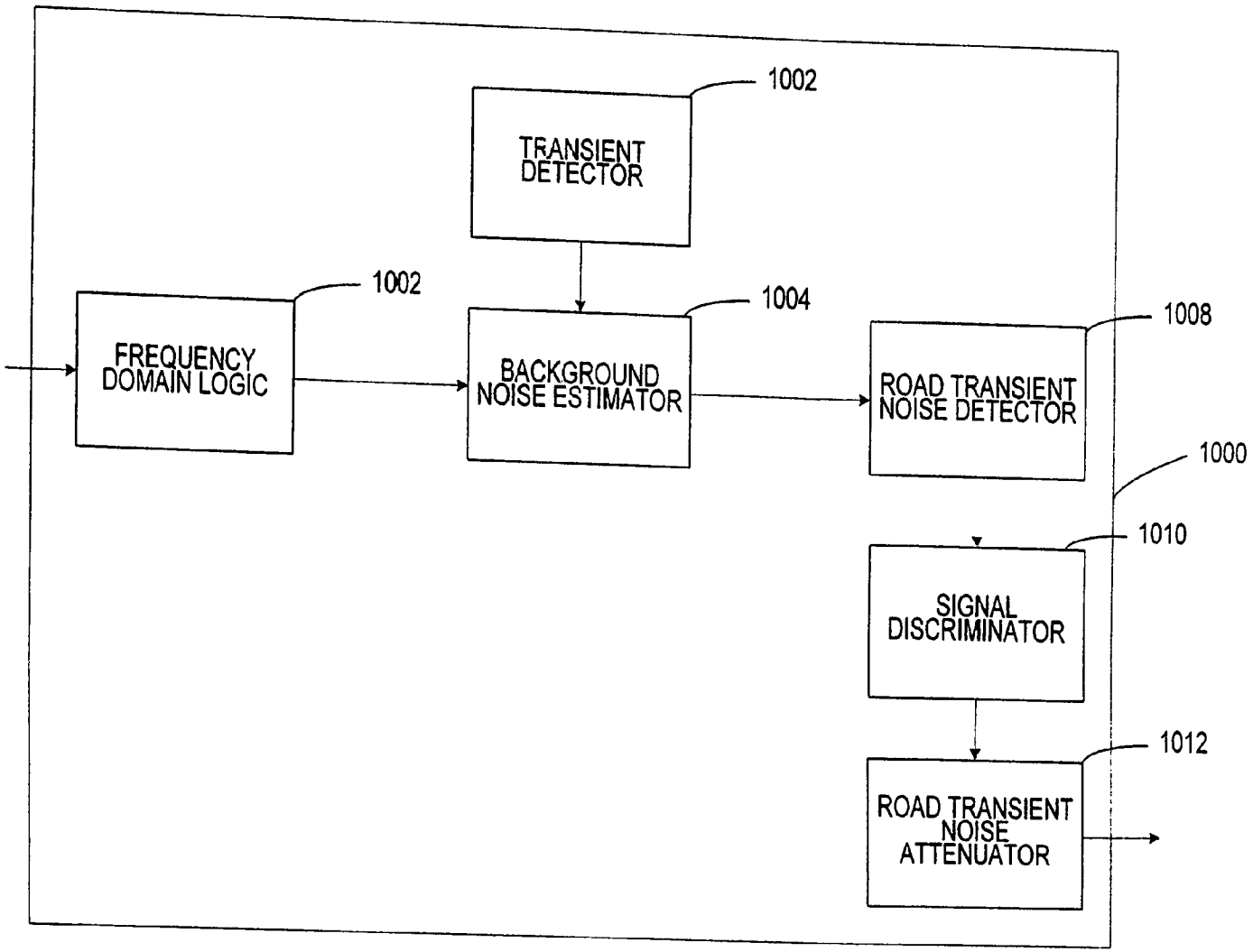
FIG. 10 is another alternative embodiment of a voice enhancement system.

FIG. 10 shows an alternative voice enhancement system 1000 that also improves the perceptual quality of a processed voice. The enhancement is accomplished by time-frequency transform logic 1002 that digitizes and converts a time varying signal to the frequency domain. A background noise estimator 1004 measures the continuous or ambient noise that occurs near a sound source or the receiver. The background noise estimator 1004 may comprise a power detector that averages the acoustic power in each frequency bin in the power, magnitude, or logarithmic domain.

To prevent biased background noise estimations at transients, a transient detector 1006 may disable or modulate the background noise estimation process during abnormal or unpredictable increases in power. In FIG. 10, the transient detector 1002 disables the background noise estimator 1004 when an instantaneous background noise B(f, i) exceeds an average background noise B(f)Ave by more than a selected decibel level 'c.' This relationship may be expressed as:

$$B(f,i)>B(f)\text{Ave}+c \qquad \text{(Equation 1)}$$

Alternatively or additionally, the average background noise may be updated depending on the signal to noise ratio (SNR). An example closed algorithm is one which adapts a leaky integrator depending on the SNR:

$$B(f)\text{Ave}'=aB(f)\text{Ave}+(1-a)S \qquad \text{(Equation 2)}$$

where a is a function of the SNR and S is the instantaneous signal. In this example, the higher the SNR, the slower the average background noise is adapted.

To detect a sound event that may correspond to a transient road noise, the transient road noise detector 1008 may fit a function to a selected portion of the signal in the time-frequency domain. A correlation between a function and the signal envelope in the time domain over one or more frequency bands may identify a sound event corresponding to a transient road noise event. The correlation threshold at which a portion of the signal is identified as a sound event potentially corresponding to a transient road noise may depend on a desired clarity of a processed voice and the variations in width and sharpness of the transient road noise. Alternatively or additionally, the system may determine a probability that the signal includes a transient road noise, and may identify a transient road noise when that probability exceeds a probability threshold. The correlation and probability thresholds may depend on various factors, including the presence of other noises or speech in the input signal. When the noise detector 1008 detects a transient road noise, the characteristics of the detected transient road noise may be provided to the noise attenuator 1012 for removal of the transient road noise.

A signal discriminator 1010 may mark the voice and noise of the spectrum in real or delayed time. Any method may be used to distinguish voice from noise. Spoken signals may be identified by (1) the narrow widths of their bands or peaks; (2) the broad resonances, which are also known as formants, which may be created by the vocal tract shape of the person speaking; (3) the rate at which certain characteristics change with time (i.e., a time-frequency model can be developed to identify spoken signals based on how they change with time); and when multiple detectors or microphones are used, (4) the correlation, differences, or similarities of the output signals of the detectors or microphones.

Figure 11:
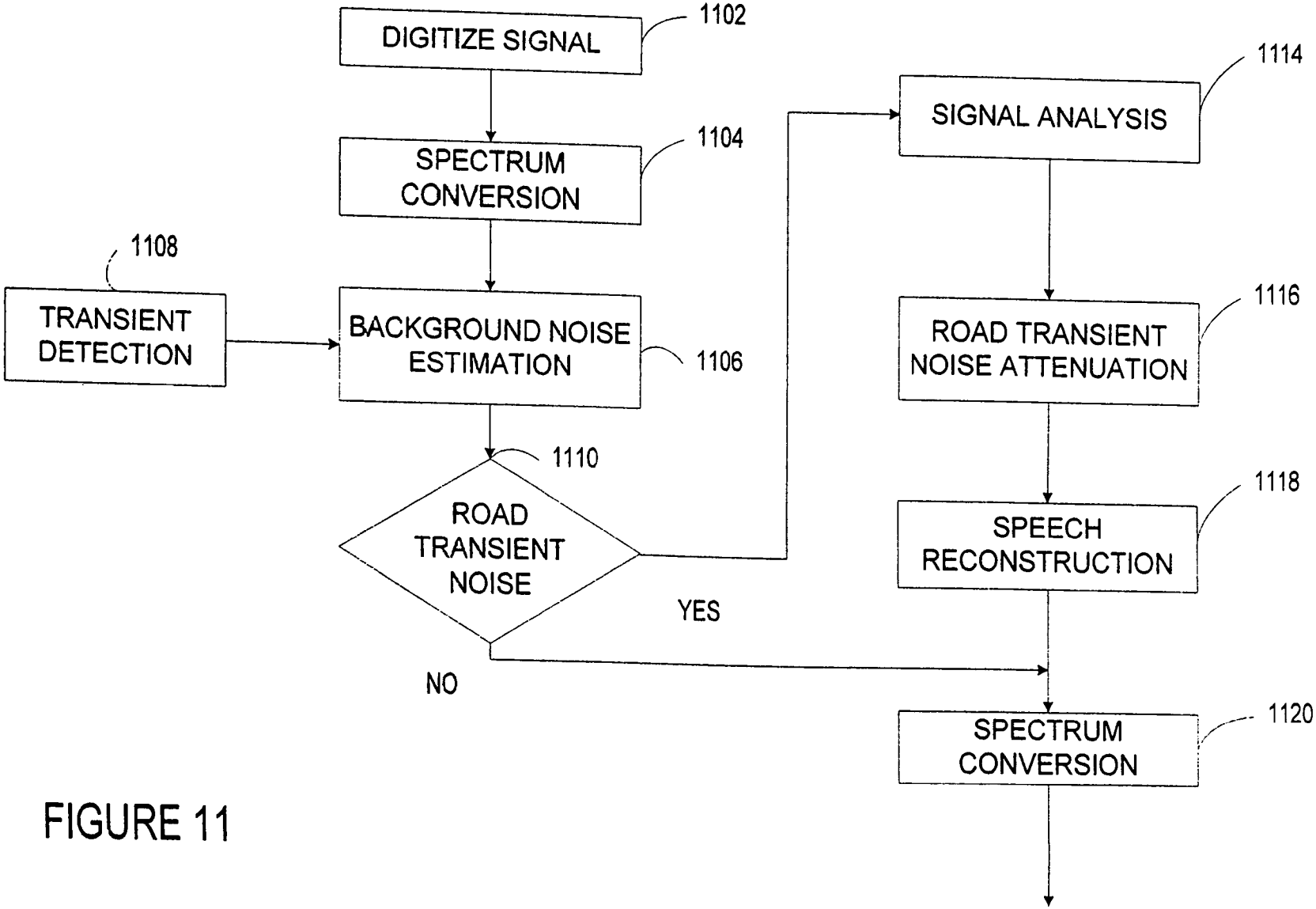
FIG. 11 is a flow diagram of a voice enhancement system that removes transient road noises from a processed voice signal.

FIG. 11 is a flow diagram of a voice enhancement system that removes transient road noises and some continuous noise to enhance the perceptual quality of a processed voice signal. At 1102 a received or detected signal is digitized at a predetermined frequency. To assure a good quality voice, the voice signal may be converted to a PCM signal by an ADC. At 1104 a complex spectrum for the windowed signal may be obtained by means of an FFT that separates the digitized signals into frequency bins, with each bin identifying an amplitude and phase across a small frequency range.

At 1106, a continuous background or ambient noise estimate is determined. The background noise estimate may comprise an average of the acoustic power in each frequency bin. To prevent biased noise estimates at transients, the noise estimate process may be disabled during abnormal or unpredictable increases in power. The transient detection 1108 disables the background noise estimate when an instantaneous background noise exceeds an average background noise by more than a predetermined decibel level.

At 1110 a transient road noise may be detected when a pair of sound events consistent with a transient road noise model are detected. The sound events may be identified by characteristics of their spectral shape or other attributes, and a pair of sound events may be confirmed as belonging to a transient road noise doublet when their temporal spacing conforms to a modeled temporal spacing for transient road noise doublets or to a calculated spacing based on vehicle speed and the length of the vehicle's wheel base. Furthermore, the detection of transient road noises may be constrained in various ways. For example, if a vowel or another harmonic structure is detected, the transient noise detection method may limit the transient noise correction to values less than or equal to average values. An additional option may be to allow the average transient road noise model or attributes of the transient road noise model, such as the spectral shape of the modeled sound events or the temporal spacing of the transient road noise doublets to be updated only during unvoiced speech segments. If a speech or speech mixed with noise segment is detected, the average transient road noise model or attributes of the transient road noise model will not be updated. If no speech is detected, the transient road noise model may be updated through various means, such as through a weighted average or a leaky integrator. Many other optional attributes or constraints may also be applied to the model.

If transient road noise is detected at 1110, a signal analysis may be performed at 1114 discriminate or mark the spoken signal from the noise-like segments. Spoken signals may be identified by (1) the narrow widths of their bands or peaks; (2) the broad resonances, which are also known as formants, which may be created by the vocal tract shape of the person speaking; (3) the rate at which certain characteristics change with time (i.e., a time-frequency model can developed to identify spoken signals based on how they change with time); and when multiple detectors or microphones are used, (4) the correlation, differences, or similarities of the output signals of the detectors or microphones.

To overcome the effects of transient road noises, a noise is substantially removed or dampened from the noisy spectrum at 1116. One exemplary method that may be employed at 1116 adds the transient road noise model to a recorded or modeled continuous noise. In the power spectrum, the modeled noise is then substantially removed from the unmodified spectrum by the methods and systems described above. If an underlying speech signal is masked by a transient road noise, or masked by a continuous noise, a conventional or modified interpolation method may be used to reconstruct the speech signal at 1118. A time series synthesis may then be used to convert the signal power to the time domain at 11120. The result is a reconstructed speech signal from which the transient road noise has been substantially removed. If no transient road noise is detected at 1110, the signal may be converted directly into the time domain at 1120 to provide the reconstructed speech signal.

The method shown in FIG. 11 may be encoded in a signal bearing medium, a computer readable medium such as a memory, programmed within a device such as one or more integrated circuits, or processed by a controller or a computer. If the methods are performed by software, the software may reside in a memory resident to or interfaced to the transient road noise detector 102, a communication interface, or any other type of non-volatile or volatile memory interfaced or resident to the voice enhancement system 100 or 1000. The memory may include an ordered listing of executable instructions for implementing logical functions. A logical function may be implemented through digital circuitry, through source code, through analog circuitry, through an analog source such as an analog electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine readable medium," "propagated-signal" medium, and/or "signal-bearing medium" may comprise any means that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

The above-described systems may condition signals received from only one or more than one microphone or detector. Many combinations of systems may be used to identify and track transient road noises. Besides the fitting of a function to a sound event suspected to be part of a transient road noise doublet, a system may detect and isolate any parts of the signal having greater energy than the modeled sound events. One or more of the systems described above may also be used in alternative voice enhancement logic.

Other alternative voice enhancement systems include combinations of the structure and functions described above. These voice enhancement systems are formed from any combination of structure and function described above or illustrated within the attached figures. The system may be implemented in software or hardware. The hardware may include a processor or a controller having volatile and/or non-volatile memory and may also include interfaces to peripheral devices through wireless and/or hardwire mediums.

Figure 12:
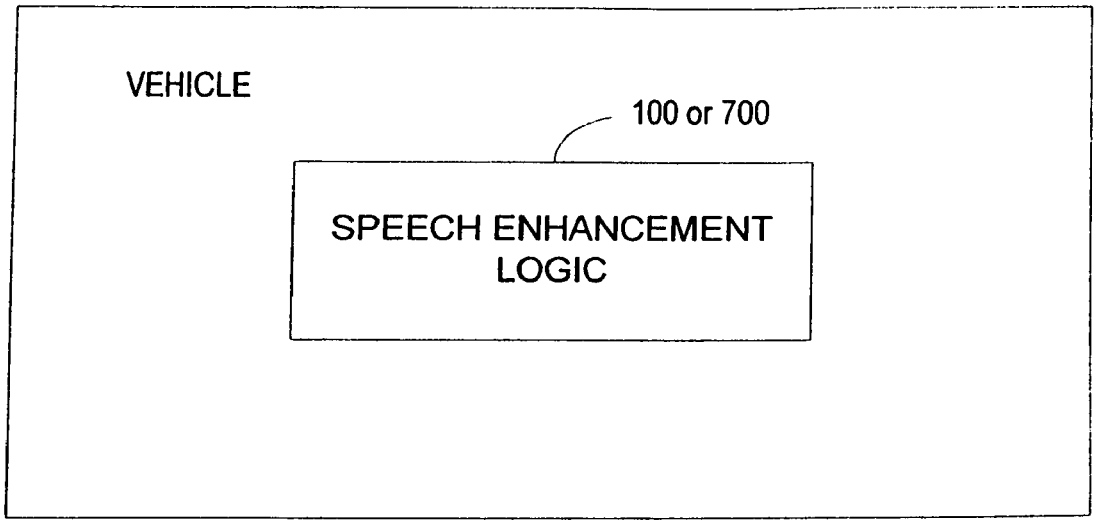
FIG. 12 is a block diagram of a voice enhancement system within a vehicle.
Figure 13:
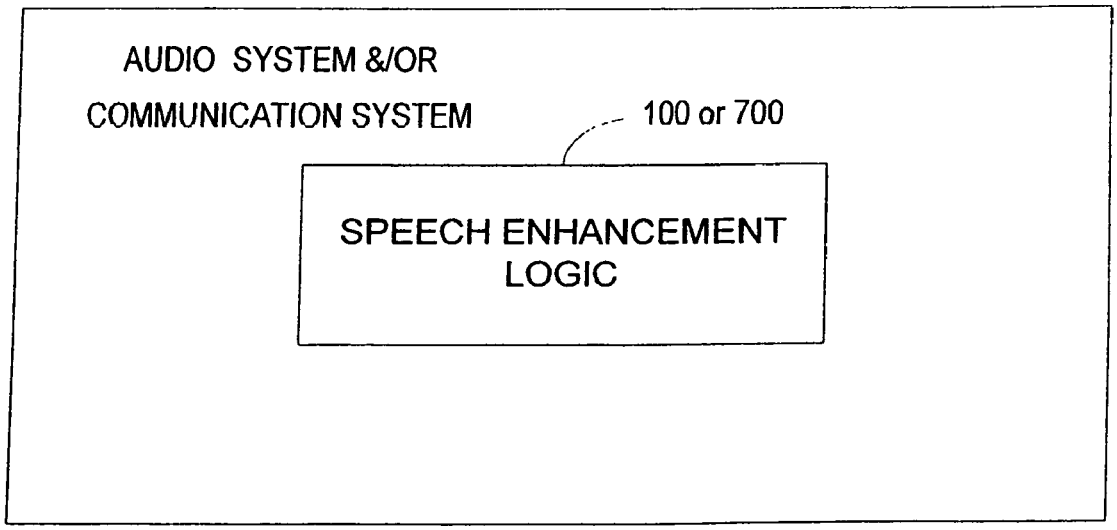
FIG. 13 is a block diagram of a voice enhancement system interfaced with an audio system and/or a navigation system and/or a communication system.

The voice enhancement system is easily adaptable to any technology or devices. Some voice enhancement systems or components interface or couple vehicles as shown in FIG. 12, instruments that convert voice and other sounds into a form that may be transmitted to remote locations, such as landline and wireless telephones and audio equipment as shown in FIG. 13, and other communication systems that may be susceptible to transient noises.

The voice enhancement system improves the perceptual quality of a processed voice. The logic may automatically learn and encode the shape and form of the noise associated with transient road noise in real time or after a delay. By tracking selected attributes, the system may eliminate, substantially eliminate, or dampen transient road noise using a limited memory that temporarily or permanently stores selected attributes of the transient road noise. The voice enhancement system may also dampen a continuous noise and/or the squeaks, squawks, chirps, clicks, drips, pops, tones, or other sound artifacts that may be generated within some voice enhancement systems and may reconstruct voice when needed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A transient road noise detector for detecting the presence of transient road noise in a signal, the transient road noise detector comprising:

an analog to digital converter that converts a received signal into a digital signal;

a windowing function generator that divides the digital signal into a plurality of individual analysis windows;

a transform module that transforms the individual analysis windows from time domain signals to frequency domain short term spectra; and a modeler that generates and stores model attributes of transient road noise, and that compares attributes of the short term spectra of the transformed analysis windows to the model attributes to determine whether a transient noise present in the received signal is a transient road noise, where the model attributes include the presence of two sound events separated by a period of time based on the speed at which a vehicle is traveling and a distance between front and rear wheels of the vehicle, and where the period of time between the two sound events is determined by an adaptive model.

2. The transient road noise detector of claim 1, further comprising an average transient road noise model generated from the plurality of individual analysis windows and wherein the model attributes comprise average transient road noise model attributes obtained from the average transient road noise model.

3. The transient road noise detector of claim 1 wherein the windowing function generator is a Hanning window function generator.

4. The transient road noise detector of claim 1 wherein the model attributes include temporal characteristics typical of transient road noises, and where the modeler identifies the transient noise as being transient road noise based on a similarity between attributes of the transient noise and the temporal characteristics typical of transient road noises.

5. The transient road noise detector of claim 1 wherein the model attributes include spectral characteristics typical of transient road noises, and where the modeler identifies the transient noise as being transient road noise based on a similarity between attributes of the short term spectra of the transformed analysis windows and the spectral characteristics typical of transient road noises.

6. The transient road noise detector of claim 1 wherein the model attributes include both temporal and spectral characteristics typical of transient road noises, and where the modeler identifies the transient noise as being transient road noise based on a similarity between attributes of the transient noise and the temporal and spectral characteristics typical of transient road noises.

7. The transient road noise detector of claim 6 wherein the model attributes include the presence of two sound events having substantially similar spectral characteristics separated by a relative short time period.

8. The transient road noise detector of claim 7 wherein the model attributes include spectral shape characteristics of the two sound events.

9. The transient road noise detector of claim 8 wherein a function is fitted to a selected portion of a signal in a time-frequency domain to evaluate spectro-temporal shape characteristics of the two sound events.

10. The transient road noise detector of claim 1 further comprising a residual attenuator for tracking a power spectrum of a signal, and when a large increase in signal power is detected, limiting a transmitted power in a low frequency range to a predetermined value based on a average spectral power of the signal in the low frequency range from an earlier period in time.

11. A method of removing transient road noises from a signal comprising:

modeling characteristics of transient road noises, where the modeled characteristics of transient road noises include a sonic doublet of two sound events separated by an amount of time corresponding to a length of time between front tires of a vehicle traveling at a rate of speed striking an obstacle and rear tires of the vehicle striking the obstacle, and where the amount of time between the two sound events is determined by an adaptive model;

analyzing the signal to determine whether characteristics of the signal correspond to the modeled characteristics of transient road noises to determine whether a transient noise present in the signal is a transient road noise; and passing the signal through a noise attenuator to substantially remove from the signal the characteristics of the signal that correspond to the modeled characteristics of transient road noises.

12. The method of claim 11 wherein the vehicle has a wheel base having a length, and wherein the length of the wheel base and the rate of speed at which the vehicle is traveling are known, the method further comprising calculating the amount of time between the two sound events corresponding to a transient road noise sonic doublet based on the length of the wheel base and the rate of speed at which the vehicle is traveling.

13. The method of claim 11 further comprising modeling a temporal separation between the two sound events comprising a sonic doublet characterizing a transient road noise.

14. The method of claim 11 wherein:

modeling comprises deriving an average transient road noise model from multiple modeled characteristics of the transient road noises; and analyzing comprises determining whether the characteristics of the signal correspond to characteristics of the average transient road noise model.

15. The method of claim 11 wherein the modeled characteristics of transient road noises further include spectral shape attributes of the sound events comprising the sonic doublet associated with transient road noises.

16. The method of claim 15 wherein the spectral shape attributes of the sound events include a broadband event with peak energy levels concentrated at relatively lower frequencies.

17. A system for suppressing transient road noises from a signal comprising:

a transient road noise detector that detects a presence of transient road noise in the signal; and a transient road noise attenuator that substantially removes transient road noise detected in the signal;

wherein the transient road noise detector includes a model of transient road noise and wherein the transient road noise detector compares an attribute of the signal with an attribute of the model, the transient road noise detector detecting the presence of a transient road noise in the signal when the transient road noise detector determines that the attribute of the signal is in substantial agreement with the attribute of the model;

wherein the model includes a spectral component and a temporal component, and the temporal component comprises a first sound event and a second substantially similar sound event separated by a period of time;

wherein the period of time between the first sound event and the second sound event is based on a speed at which a vehicle is traveling and a distance between front and rear wheels of the vehicle; and wherein the period of time between the first sound event and the second sound event is determined by an adaptive model.

* * * * *